United States Patent [19]

Walsh

[11] 4,313,284

[45] Feb. 2, 1982

[54] APPARATUS FOR IMPROVING FLATNESS OF POLISHED WAFERS

[75] Inventor: Robert J. Walsh, Ballwin, Mo.

[73] Assignee: Monsanto Company, St. Louis, Mo.

[21] Appl. No.: 134,714

[22] Filed: Mar. 27, 1980

[51] Int. Cl.[3] ..... B24B 7/04

[52] U.S. Cl. ..... 51/131.4; 51/235

[58] Field of Search ..... 51/131 R, 131.4, 131.5, 51/235

[56] References Cited

U.S. PATENT DOCUMENTS

| | | | |
|---|---|---|---|
| 2,241,478 | 5/1941 | Remington | 51/235 UX |
| 3,170,273 | 2/1965 | Walsh | 51/ |
| 3,475,867 | 11/1969 | Walsh | 51/ |
| 3,611,654 | 10/1971 | Weber | 51/131.4 |
| 3,693,301 | 9/1972 | Lemaitre | 51/235 |
| 3,747,282 | 7/1973 | Katzke | 51/235 |
| 3,977,130 | 8/1976 | Degner | 51/131.4 |

*Primary Examiner*—Harold D. Whitehead
*Attorney, Agent, or Firm*—Henry Croskell

[57] ABSTRACT

Apparatus for improving polished wafer flatness such as slices of semiconductor materials through mounting of the wafers onto a deformable thin disc carrier which is mounted through a resilient device to a rotable pressure plate, the combined mounting being rotably engageable with a rotable turntable supported polishing surface, the turntable having an axis of rotation to edge bow away from the mounted wafers. The carrier is deformed to a concave shape opening toward the bowed table; thus permitting the mounted wafers to achieve through rotation polishing, uniformly improved flatness.

5 Claims, 4 Drawing Figures

APPARATUS FOR IMPROVING FLATNESS OF POLISHED WAFERS

BACKGROUND OF THE INVENTION

This invention relates to processing of thin semiconductor wafers such as slices of semiconductor silicon and, more particularly, to improved method and apparatus for polishing wafers having uniform flatness of the polished surface, the improved polished wafer flatness is achieved through adjusting the contact surface profile of the wafers as carried by a pressure plate in contact with a polishing surface supported by a turntable which exhibits a thermal and mechanical bow from its axis of rotation to its edge.

Modern chemical-mechanical semiconductor polishing processes are typically carried out on equipment where the wafers are secured to a carrier plate by a mounting medium, with the wafers having a force load applied thereto through the carrier by a pressure plate so as to press the wafers into frictional contact with a polishing pad mounted on a rotating turntable. The carrier and pressure plate also rotate as a result of either the driving friction from the turntable or rotation drive means directly attached to the pressure plate. Frictional heat generated at the wafer surface enhances the chemical action of the polishing fluid and thus increases the polishing rate. Such polishing fluids are disclosed and claimed in Walsh Et Al. U.S. Pat. No. 3,170,273. Increased electronic industry demand for polished semiconductor wafers has promoted need for faster polishing rates requiring sizable loads and substantial power input for the polishing apparatus. This increased power input appears as frictional heat at the wafer surface. In order to prevent excessive temperature buildup, heat is removed from the system by cooling the turntable. A typical turntable cooling system consists of a coaxial cooling water inlet and outlet through a turntable shaft along with cooling channels inside the turntable properly baffled to prevent bypassing between inlet and outlet. However, it has been found that a major cause of distortion of wafer surfaces is resulting from a bow distortion of the turntable supported polishing surface substantially resulting from the heat flow from the wafer surface to the cool water which causes the top surface of the turntable to be at a higher temperature than the bottom surface. This temperature difference results in a thermal expansion differential causing the turntable surface to deflect toward the cool surface from the axis of rotation to the outside edge.

The wafer carrier is thermally insulated from the pressure plate by a resilient pressure pad. Therefore, the carrier approaches thermal equilibrium at a substantially uniform temperature and remains flat. The difference in curvature between the plane defined by the wafers and the bowed surface of the turntable results in excessive stock removal toward the center of the carrier causing non-uniform wafer thickness and poor flatness. This lack of uniformity and flatness is also enhanced by larger wafer sizes required by modern technology thus leading to a very serious problem for the end use of said polished wafers for example the use of silicon polished wafers for large scale integrated (LSI) circuit manufacture and very large-scale integrated (VLSI) circuit applications. These applications require substantially flat polished wafer surfaces in order to achieve high resolution in the photolithographic steps of the integrated circuit manufacturing process.

Recent technological advances have enhanced methods of mounting the semiconductor slices to the carrier plate which allow the wafers to be subjected to operations including washing, lapping, polishing, and the like without mechanical distortion or unflatness of the polished wafers. For example, when utilizing the methodology for wax mounting of silicon wafers to carrier plates for further operations thereon, and particularly polishing to a high degree of surface perfection as appropriate for the manufacture of integrated circuits on such wafers, it has been observed that entrapped air bubbles in the wax layer under the slice create imperfections in the products which result from prior art methodology. Such imperfect methodology has been corrected by the invention disclosed and claimed in the recent Walsh U.S. application, Ser. No. 126,807, filed Mar. 3, 1980, entitled "Method and Apparatus for Wax Mounting of Thin Wafers for Polishing". The corrections afforded by Walsh's mounting methods are of little assistance in achieving uniform polished flatness of semiconductor wafers if the final polishing does not accommodate the continuation of uniform flatness. Modern requirements of the semiconductor industry regarding polished silicon wafers cannot tolerate surface flatness variations. In the manufacture of VLSI circuits, a high density of the circuit elements must be created on a silicon wafer requiring an extraordinarily high order of precision and resolution calling for wafer flatness heretofore not required. The necessary polished slice flatness for such applications, for example, less than about 2 micrometers peak to valley, cannot be achieved if the carrier mounted wafers are polished against a thermally-mechanically bowed polishing surface.

SUMMARY OF THE INVENTION

It is an object of the invention to provide a apparatus for improving polished wafer flatness through mechanical adjustment of the wafers polishing contact surface achieved by mechanically bowing the carrier disc on which the wafers are mounted.

It is a further object of the invention to provide apparatus for mounting wafers onto a deformable carrier which permits the avoidance of flatness deformaties when said wafers are brought in contact with a bowed-polishing surface.

Other objects and features of the invention will be in part apparent and in part pointed out hereinbelow.

BRIEF DESCRIPTION OF THE DRAWINGS

FIG. 3 and FIG. 1 are representative of the prior art methodology and do not represent the method or apparatus according to the invention.

Correspondingly reference characters indicate corresponding parts throughout the several views of the drawings.

DESCRIPTION OF THE PREFERRED EMBODIMENTS

Figure 1:
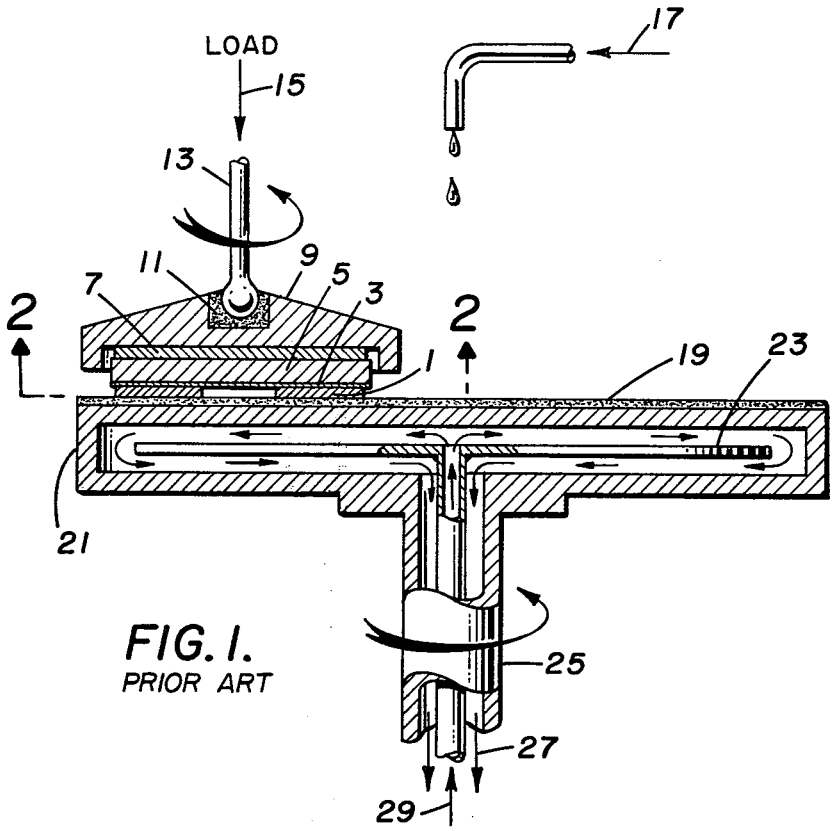
FIG. 1. PRIOR ART
FIG. 1 is a schematic illustration of the apparatus, illustrated in cross section, for carrying out a method for polishing wafers mounted on a carrier and pressure plate combination against a rotating turntable mounted polishing head. The apparatus as illustrated in FIG. 1 is representative of the prior art.

Referring to the drawings, current chemical-mechanical polishing processes for silicon and other semiconductor wafers are typically carried out on equipment as illustrated in FIG. 1. The wafers 1 are secured to the carrier 5 through mounting medium 3 which may be either a wax or any of several waxless mounting media which provide wafers with a friction, surface tension or other means for adhering to the carrier 5. The carrier is mounted through resilient pressure pad 7 means to pressure plate 9 which is suitably mounted to a spindle 13 through bearing mechanism 11, the spindle 13 and bearing 11 supporting a load 15 which is exerted against the pressure plate 9 and finally against wafers 1 when said wafers are in rotatable contact with polishing pad 19 during operation, for example, when turntable 21 is rotating thus forcing the rotation of the carrier 5 through friction means or independent drive means. The turntable 21 is rotated around shaft 25 which includes cooling water exit 27 and inlet 29 in communication with the hollow chamber inside the turntable and as the two streams are separated by baffle 23.

Figure 3:
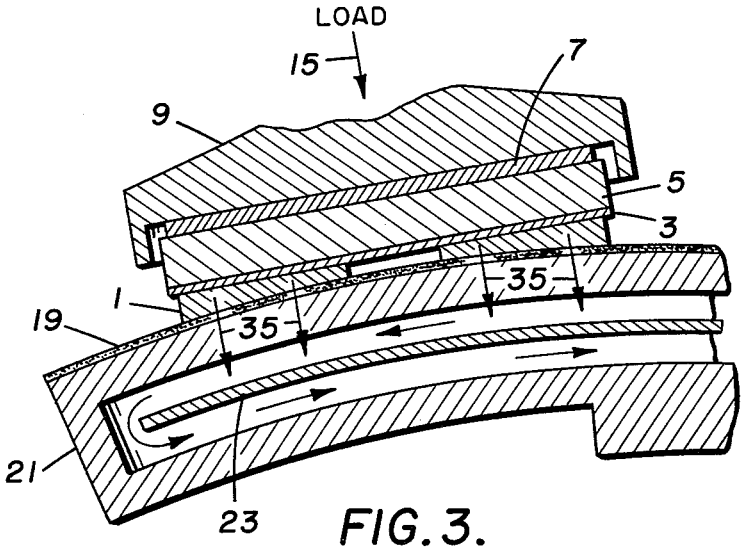
FIG. 3. PRIOR ART
FIG. 3 is an enlarged illustration of a section of the apparatus as shown in FIG. 1 which illustrates the cross-section non-planar contact of the wafers with the water-cooled bowed turntable which supports the polishing pad.
Figure 4:
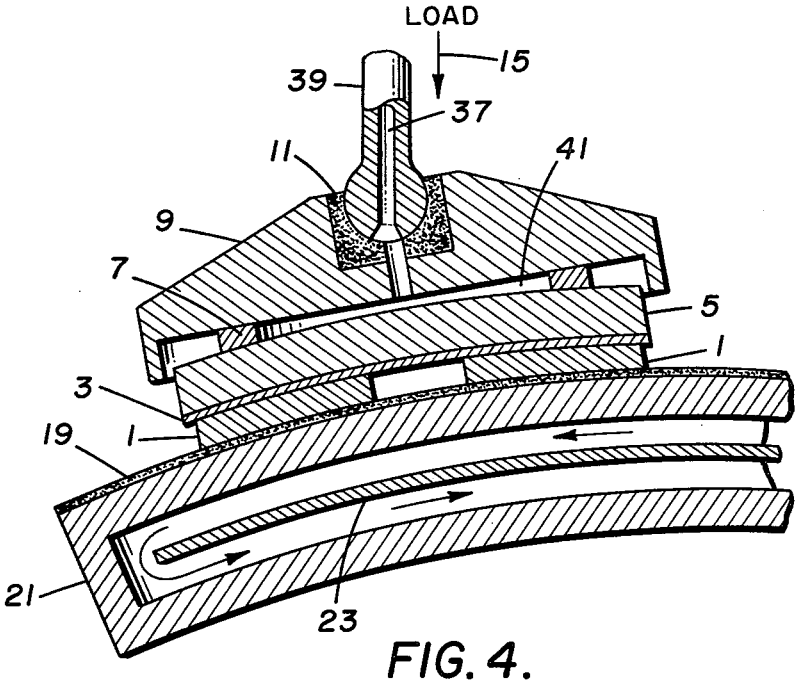
FIG. 4 is a fragmentary view of portions of the apparatus according to the invention and is related to the apparatus of FIG. 1 wherein the wafer carrier is deformed in a concave shape with wafers mounted thereon for non-planar contact with the bowed polishing surface-turntable apparatus.

The greater polishing rates required today introduce increased loads and substantial power input into the polishing methodology. This increased speed and higher input appears as frictional heat at the wafer surface during polishing. In order to prevent excessive buildup, heat is removed from the system by cooling the turntable as illustrated in FIGS. 1, 3, and 4.

When polishing silicon wafers with apparatus of the type illustrated in FIG. 1, it has been found that the stock removal is not uniform across the surfaces of the wafers mounted on the carrier but is greater toward the center of the carrier and less toward the outside edge of the carrier. This results in a general tapering of the wafers in the radial direction from the center of the carrier.

Figure 2:
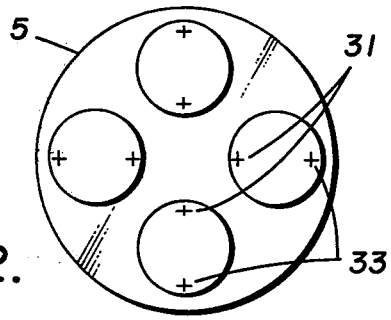
FIG. 2 is a vertical cross section of the wafer mounted carrier taken along line 2—2 of FIG. 1.

The radial taper (RT) is defined for the purposes of this disclosure as: $RT=T_o-T_i$.

Where $T_o$ 33 is the wafer thickness $\frac{1}{8}''$ from the outside edge and $T_i$ 31 is the wafer thickness $\frac{1}{8}''$ from the inside edge of the wafer as shown in FIG. 2. It is not uncommon to encounter radial taper readings up to 15 micrometers on the larger wafer sizes. Modern semiconductor technology has increased demand for larger diameter silicon wafers; therefore the radial taper deficiency is further exaggerated by these diameter enlargements. Wafers with significant radial taper have relatively poor flatness; thus creating a serious problem for LSI and VLSI wafer applications.

The radial taper problem is substantially the result of distortion of the turntable from a flat surface or planar surface to an upwardly convex surface resulting from thermal and mechanical stress. This phenomenon is shown in exaggerated form in FIG. 3. A major portion of the distortion is thermally caused by the heat flow 35 from the wafer 1 surfaces to the cooling water which causes the top surface of the turntable to be at a higher temperature than the bottom surface which is essentially at the cooling water temperature. This temperature difference results in a thermal expansion differential causing the turntable surface and polishing pad 19 mounted thereon to deflect downward at the outside edge. The carrier 5 is thermally insulated from the pressure plate 9 by a resilient pressure pad 7. Therefore, the carrier reaches equilibrium at a substantially uniform temperature and remains flat. The difference in curvature between the carrier 5 and the turntable 21 results in excessive stock removal toward the center of the carrier 5 causing the radial taper problem. Solutions other than methodology and apparatus of this invention which partially eliminate the problem would of course be to reduce the polishing rate and thus the heat flux until distortion is tolerable. However, such reduction of rate would greatly reduce the wafer through put of the polishing apparatus and therefore increase wafer polishing cost. A more economical solution is achieved through the methodology and apparatus according to the invention which has produced an apparatus adjustment which compensates for the geometric problems flowing from heat flux while maintaining equal or higher polishing rates.

In FIG. 4, the hollow spindle 39 and pressure plate 9 are designed according to the invention to incorporate a vacuum port 37 communicating to the space or vacuum chamber between pressure plate 9, carrier 5 and resilient pad 7. The full surface resilient pressure pad of prior art apparatus can be replaced by an annular resilient ring and the pressure pad material is chosen to be impermiable to air such as rubber or elastomeric polymer materials. During a polishing cycle a vacuum source is connected to the vacuum port and the air space between the carrier 5 and pressure plate 9 is partially exhausted. The differential pressure across the carrier 5 distorts or deforms the carrier into a concave shape opening downwardly which can be made to match the distorted surface of the turntable as shown in FIG. 4. Wafers polished in this way show greatly-improved radial taper and flatness.

In practice the carrier 5 distortion is adjusted by varying the amount of vacuum and/or the diameter (area) of the annular pressure pad until satisfactory radial taper and flatness are obtained. In some cases it could be necessary to change the thickness of the carrier plate to bring the distortion into the proper range in order to match the distortion of the turntable.

The following examples, examples 2 through 6, illustrate the results of the invention as compared to example 1 which shows a prior art application.

EXAMPLES

The methodology and apparatus as illustrated in FIGS. 1, 3 and 4 were applied in polishing 100 milimeter silicon wafers. The carrier plates were 0.5 inches thick having a diameter of 12.5 inches and were constructed of stainless steel. The annular pressure pad was 20.3 cm inside diameter and 26.7 cm outside diameter. Polishing temperature was about 53° C. and the following results were achieved with the only variable being applied vacuum in inches mecury.

The following Table shows the effect of varying the applied vacuum on RT and flatness of 100 mm polished wafers:

TABLE

| Examples | APPLIED VACUUM CM HG | RADIAL TAPER AVG μm | WAFER FLATNESS AVG μm |
|---|---|---|---|
| 1 | 0 | 11.9 | 4.0 |
| 2 | 22.3 | 9.9 | 2.4 |
| 3 | 35.6 | 7.6 | 1.4 |
| 4 | 50.8 | 3.3 | 1.1 |
| 5 | 61.0 | 0.2 | 0.9 |
| 6 | 68.6 | −2.3 | 1.7 |

It is readily apparent from the data contained in the Table that the effectiveness of the method and process according to the invention reaches physical limitations within any practice environment, i.e. note that in example 6 the carrier plate concave deformity overcomes to a negative degree the turntable bow and the results are undesirable. The data illustrated by examples 1 through 6 clearly demonstrate the usefulness of the present invention as opposed to prior art methods as in example 1 and overcompensation according to the invention as shown by example 6.

Although the foregoing includes a discussion of the best mode contemplated for carrying out the invention, various modifications can be made and still be within the spirit and scope of the inventive disclosure.

As various modifications can be made in the method and construction herein described and illustrated without departing from the scope of the invention, it is intended that all matter contained in the foregoing description or shown in the accompanying drawings shall be interpreted as illustrative rather than limiting.

What is claimed is:

1. Apparatus for improving polished wafer flatness comprising:

a thin deformable carrier disc mounted to a resilient ring which is mounted to a rotable pressure plate, said pressure plate, resilient ring, and first carrier surface forming a chamber, said chamber in communication with a vacuum means for deforming said carrier disc into an inwardly convex shape toward the chamber; said deformed carrier having wafers mounted on a second surface which is concave; said wafers rotably engageable with a polishing pad mounted turntable having an internal cooling means for disapating heat from the polishing pad and first surface of the turntable, the turntable second surface being cooler than the first surface during polishing resulting in a thermal bow of the turntable toward the second surface.

2. The apparatus according to claim 1 wherein the wafers are wax mounted to the concave surface of the carrier.

3. The apparatus according to claim 1 wherein the rotable turntable provides frictional drive rotation of the wafer mounted carrier, pressure plate.

4. Apparatus according to claim 1 wherein the wafers are rotated through an independent pressure plate rotation drive means.

5. Apparatus according to claim 1 wherein multiple pressure plate, carrier apparatus are engageable with the turntable, the multiple apparatus being engageable with the turntable in respective radius dimensions of the turntable.

* * * * *